US007322489B2

(12) United States Patent
Long

(10) Patent No.: US 7,322,489 B2
(45) Date of Patent: Jan. 29, 2008

(54) INTERFOLDED STACK OF SHEET MATERIAL

(75) Inventor: Leslie Thomas Long, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 349 days.

(21) Appl. No.: 11/097,624

(22) Filed: Apr. 1, 2005

(65) Prior Publication Data

US 2006/0219731 A1 Oct. 5, 2006

(51) Int. Cl.
*A47K 10/24* (2006.01)

(52) U.S. Cl. ..... 221/48; 221/38

(58) Field of Classification Search ..... 221/38, 221/48

See application file for complete search history.

(56) References Cited

U.S. PATENT DOCUMENTS

| | | | | |
|---|---|---|---|---|
| 2,761,676 | A | 9/1956 | Reinhardt et al. | |
| 3,679,094 | A | 7/1972 | Nissen et al. | |
| 3,679,095 | A | 7/1972 | Nissen et al. | |
| 3,817,514 | A | 6/1974 | Nissen et al. | |
| 3,845,948 | A | 11/1974 | Furbeck et al. | |
| 5,215,757 | A | 6/1993 | El-Nokaly | |
| 5,497,903 | A | 3/1996 | Yoneyama | |
| 5,599,555 | A | 2/1997 | El-Nokaly | |
| 5,980,931 | A | 11/1999 | Fowler et al. | |
| 6,045,002 | A * | 4/2000 | Wierschke | 221/48 |
| 6,121,165 | A | 9/2000 | Mackey et al. | |
| 6,168,848 | B1 | 1/2001 | Heath | |
| 6,202,845 | B1 | 3/2001 | Hill | |
| 6,213,344 | B1 | 4/2001 | Hill | |
| 6,238,328 | B1 | 5/2001 | Loppnow et al. | |
| 6,250,495 | B1 | 6/2001 | Bando | |
| 6,286,712 | B1 | 9/2001 | Craig et al. | |
| 6,543,643 | B2 | 4/2003 | Iida et al. | |
| 6,550,634 | B1 | 4/2003 | Alegre De Miquel et al. | |
| 6,644,500 | B2 | 11/2003 | De Angelis et al. | |
| 6,671,475 | B2 | 12/2003 | Katada et al. | |
| 6,685,050 | B2 * | 2/2004 | Schmidt et al. | 221/48 |
| 6,730,012 | B2 | 5/2004 | Bando | |
| 6,732,492 | B2 * | 5/2004 | Osborne et al. | 53/429 |
| 2003/0116581 | A1 | 6/2003 | Schmidt et al. | |
| 2005/0058807 | A1 | 3/2005 | Hochtritt et al. | |

FOREIGN PATENT DOCUMENTS

| | | |
|---|---|---|
| DE | 43 36 933 A1 | 5/1995 |
| EP | 1 188 404 A2 | 3/2002 |
| EP | 1 213 230 A1 | 6/2002 |
| EP | 1 195 333 B1 | 3/2004 |

* cited by examiner

*Primary Examiner*—Gene O. Crawford
*Assistant Examiner*—Timothy Waggoner
(74) *Attorney, Agent, or Firm*—Scott A. Baum; Gregory E. Croft

(57) ABSTRACT

By reducing the overlap distance O of the interfolded sheets in the upper layer of a stack of interfolded sheets, sheet tears and/or multiple dispensing can be avoided for the initial sheets dispensed. By increasing the overlap distance O of the interfolded sheets in the lower layer of a stack of interfolded sheets, fallback of the subsequent sheets can be avoided. To maximize the number of sheets that can be placed into the same sized dispenser, the folded width of all sheets in the stack should be substantially the same. The interfolded stack is especially useful in an upright dispenser to improve sheet dispensing, but can also be utilized in a flat dispenser.

14 Claims, 7 Drawing Sheets

INTERFOLDED STACK OF SHEET MATERIAL

BACKGROUND

Sheet materials, such as tissue paper, are often interfolded into stacks or clips and then placed into a dispenser such that, upon removal of one sheet, a subsequent sheet is partially dispensed having an exposed portion that extends from the dispenser's opening. This method of pop-up sheet dispensing is convenient for many applications, since the next sheet is readily presented for quick access.

Three common dispensing problems often result during pop-up dispensing. The first problem can be sheet tears for the dispensed sheets; especially, from a full or nearly full dispenser. The second problem can be fallback where the next sheet in the dispenser fails to be partially withdrawn through the dispensing opening upon removal of the preceding sheet. Fallback can occur because there is insufficient interfolding of the sheets to create enough interlayer sheet-to-sheet friction to partially withdraw the next sheet. The third problem, multiple dispensing, happens when withdrawing one sheet causes one or more additional sheets to be withdrawn unintentionally. Multiple dispensing can occur because there is too much interfolding of the sheets creating more interlayer friction than desired, causing additional sheets to be withdrawn in a chaining or linking effect.

Conventional dispensers or cartons are available in a variety of designs and shapes, but they can generally be classified as either one of two basic styles. One style is the flat carton and the other is the upright or boutique carton. In the flat style cartons, the sheets are laid flat in the bottom of the carton and are withdrawn from an opening in the top of the carton or through an opening in the top which partially extends down the front sidewall. The sheets within the carton may be interfolded for pop-up dispensing or merely laid on top of each other for reach-in dispensing.

In the other style carton, the sheets are packaged in an upright or boutique type dispenser by folding the stack. The upright dispenser can be preferred since it has a smaller footprint than flat dispensers. To dispense the sheets from an upright dispenser, the sheet material is typically interfolded into a stack or clip of tissues and then the clip is folded symmetrically in half about a transverse central axis of the clip to form a U-shaped folded clip that is loaded into the dispenser. The U-shaped clip is loaded into the dispenser such that the radius of the U is beneath the dispensing window located in the dispenser's top.

Loading an upright dispenser with the U-shaped clip can cause the first few sheets to be difficult to remove and/or tear, especially as the number of sheets in the dispenser is increased or as the bulk/thickness or number of plies of the sheet material is increased. The sheets can be pushed tightly against the opposing vertical walls of the upright dispenser after the folded clip is placed in the dispenser since the clip tends to spring back into an uncompressed state. This can lead to tearing of the sheet material as the sheets are dispensed. This is particularly true for the initial sheets dispensed after the carton is opened. The problem is often lessened as the sheets within the carton are used up and the compression of the clip is reduced.

Increasing the overall size of the upright dispenser or reducing the number of sheets in the clip are both viewed as unacceptable solutions. The current size of the upright dispenser has become standardized, and many people have decorative covers designed to fit over the size of an upright dispenser. Reducing the number of sheets will impact the perceived value by a purchaser who expects to receive a significant number of sheets such that the product will last a long time in use.

One approach to solving this problem is to add a dynamic friction reducing material to the inside of the carton as disclosed in U.S. Pat. No. 6,672,475, entitled Dispensing Carton for Paper Sheet Products that issued on Jan. 6, 2004, to Ho et al. This approach tries to reduce the friction between the clip and the inside of the dispenser by extending the poly film dispensing window on the inside of the dispenser. However, simply reducing the friction of the clip's outer sheet with the carton will not guarantee that the initial sheets will not tear. In the U-shaped clip there is present a substantial amount of interlayer sheet-to-sheet friction between the interfolded sheets. Additionally, adding the dynamic friction reducing material to the dispenser increases the incremental cost of the dispenser, which cannot always be passed on by the manufacturer as a cost increase.

Another approach to solving this problem in a flat dispenser containing wet sheets is disclosed in U.S. Pat. No. 6,543,643, entitled Sheet Package that issued on Apr. 8, 2003, to Iida et al. This approach reduces the folded width of the upper layer sheets in the stack as compared to the lower layer sheets such that the initial sheets are easier to remove through the dispensing opening. While this approach may be useful for flat dispensers containing wet sheets, the approach can be unsuitable for upright dispensers. By reducing the folded width of the sheets in the upper layer, the overall height of the stack is increased. This occurs because if the folded width is reduced for a sheet having the same initial size, then the corresponding folded height must also be increased. When the now taller stack is folded into a U-shape and then placed into an upright dispenser, the initial clip compression is actually increased from the wider stack being compressed more by the dispenser resulting in more sheet tears. This is the exact opposite of the intended result. If the taller stack is used in a flat dispenser, the size of the dispenser must be increased to accommodate the taller stack, or fewer sheets must be placed into the stack to fit the currently existing dispenser.

Thus, what is needed is an interfolded stack that can dispense more sheets from the same sized dispenser while still achieving acceptable dispensing with a minimum of the above discussed problems. Alternatively, what is needed is an interfolded stack that can dispense the same number of sheets from the same sized dispenser with a reduction in the above discussed dispensing problems. Alternatively, an interfolded stack that contains more sheets and dispenses them with a reduction in dispensing problems from the same sized dispenser is also needed.

SUMMARY

The inventor has discovered that by reducing the overlap distance of the interfolded sheets in the initial part of the stack, sheet tears and/or multiple dispensing can be avoided for the initial sheets dispensed. The inventor has also discovered that by increasing the overlap distance of the interfolded sheets for the remaining stack portion, fallback of the subsequently dispensed sheets can also be avoided. To maximize the number of sheets that can be placed into the same sized dispenser, the folded width of all sheets in the stack should be substantially the same.

In one embodiment of the invention, the upper layer sheets are Z-folded with an initial overlap distance $O_i$ and then the overlap distance is progressively increased over the first ten sheets to a final overlap distance $O_f$. After the eleven sheets, the lower layer sheets in the stack are V-folded. In another embodiment of the invention, the upper layer sheets are C-folded with an initial overlap distance $O_i$ and then the overlap distance is progressively increased over the first ten sheets to a final overlap distance $O_f$. After the first eleven sheets, the lower layer sheets in the stack are V-folded. In another embodiment of the invention, the upper layer sheets are Z-folded with a constant overlap distance O for the first six sheets and then the Z-folded upper layer is interfolded with the lower layer including a plurality of V-folded sheets.

Hence in one aspect, the invention resides in a product including: an interfolded stack containing a plurality of individual interleaved sheets folded from a sheet material; each of the sheets having substantially the same overall folded width and having an overlap distance O representing the distance a preceding sheet is in interleaved contact with a subsequent sheet; the stack having an upper layer and a lower layer; and wherein the overlap distance O is less for the sheets in the upper layer than for the sheets in the lower layer.

BRIEF DESCRIPTION OF THE DRAWINGS

The above aspects and other features, aspects, and advantages of the present invention will become better understood with regard to the following description, claims, and accompanying drawings in which:

DEFINITIONS

Figure 1:
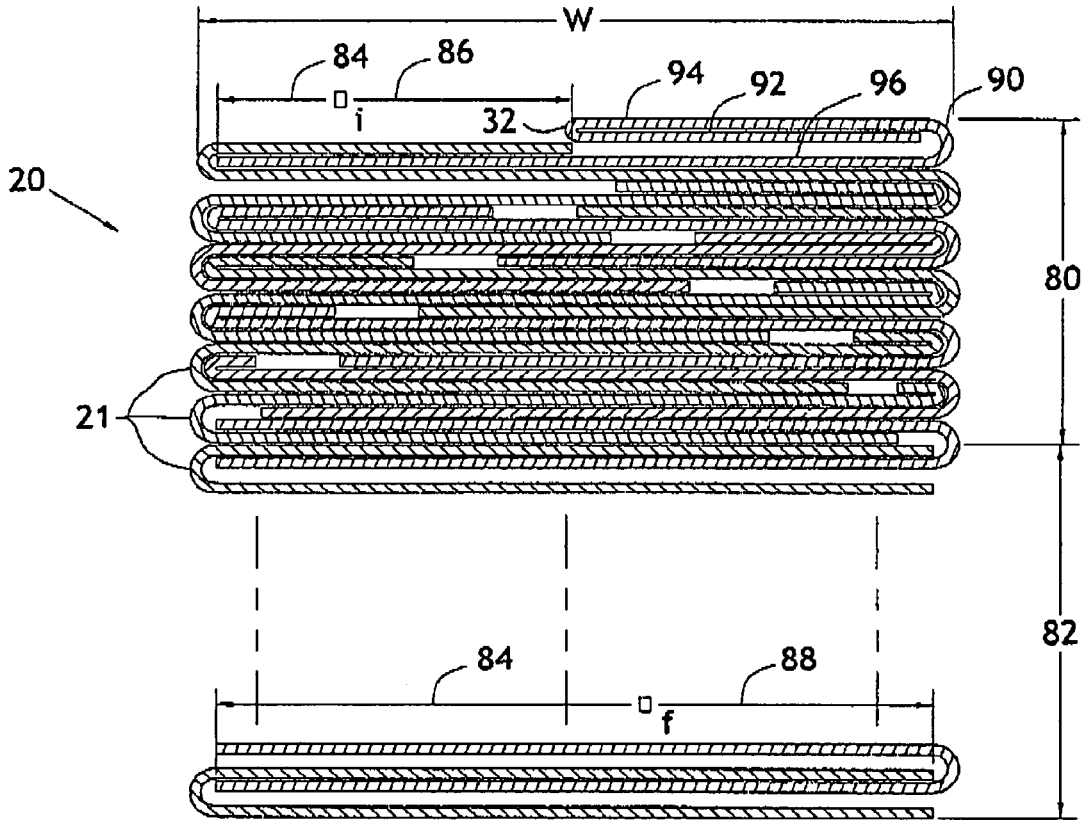
FIG. 1 illustrates an end view of an interfolded stack of sheets of the present invention.

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "sheet material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; single or multi-ply paper substrates comprising cellulose such as tissue paper, toilet paper, facial tissue, or paper towels; waxed paper substrates; conform substrates comprising cellulose fibers and polymer fibers; wet substrates such as wet wipes, moist cleaning wipes, moist toilet paper, and baby wipes; film or plastic substrates such as those used to wrap food; and shop towels. Furthermore, laminated or plied together substrates of two or more layers of any of the preceding substrates are also suitable.

As used herein, "wet sheet material" includes substrates that are either wet or pre-moistened by an appropriate liquid, partially moistened by an appropriate liquid, or containing encapsulated liquids. Wet sheet materials generally have a moisture content of greater than about 10% by weight of the dry substrate. Suitable wet sheet materials can have encapsulated ingredients such that the capsules rupture during dispensing or use. Examples of encapsulated materials include those disclosed in U.S. Pat. No. 5,215,757, entitled Encapsulated Materials and issued to El-Nokaly on Jun. 1, 1993, and U.S. Pat. No. 5,599,555, entitled Encapsulated Cosmetic Compositions and issued to El-Nokaly on Feb. 4, 1997. Other suitable wet sheet materials include dry substrates that deliver liquid when subjected to in-use shear and compressive forces. Such substrates are disclosed in U.S. Pat. No. 6,121,165, entitled Wet-Like Cleaning Articles and issued to Mackay et al. Sep. 19, 2000.

As used herein "substantially dry sheet material" includes substrates that are initially dry (less than about 10% by weight of the substrate water or liquid) but intended to be moistened prior to use by placing the substrate into an appropriate liquid such as water or a solvent. Non-limiting examples of substantially dry substrates include substrates containing lathering surfactants and conditioning agents either impregnated into or applied to the substrate such that wetting of the substrate with water prior to use yields a personal cleansing product. Such substrates are disclosed in U.S. Pat. No. 5,980,931, entitled Cleansing Products Having A Substantially Dry Substrate and issued to Fowler et al. on Nov. 9, 1999.

As used herein, an "upright dispenser" is a dispenser that dispenses interfolded sheets that have been assembled into a stack or clip and the stack is folded about a transverse fold axis forming a folded clip that is inserted into the dispenser. In one embodiment, the upright dispenser comprises a tissue carton made from board stock having an overall height of approximately 127 mm and a footprint or bottom of approximately 110 mm by 110 mm that forms a parallelepiped, having a generally cubical shape that houses a plurality of individual single or multi-ply facial tissue sheets.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 2:
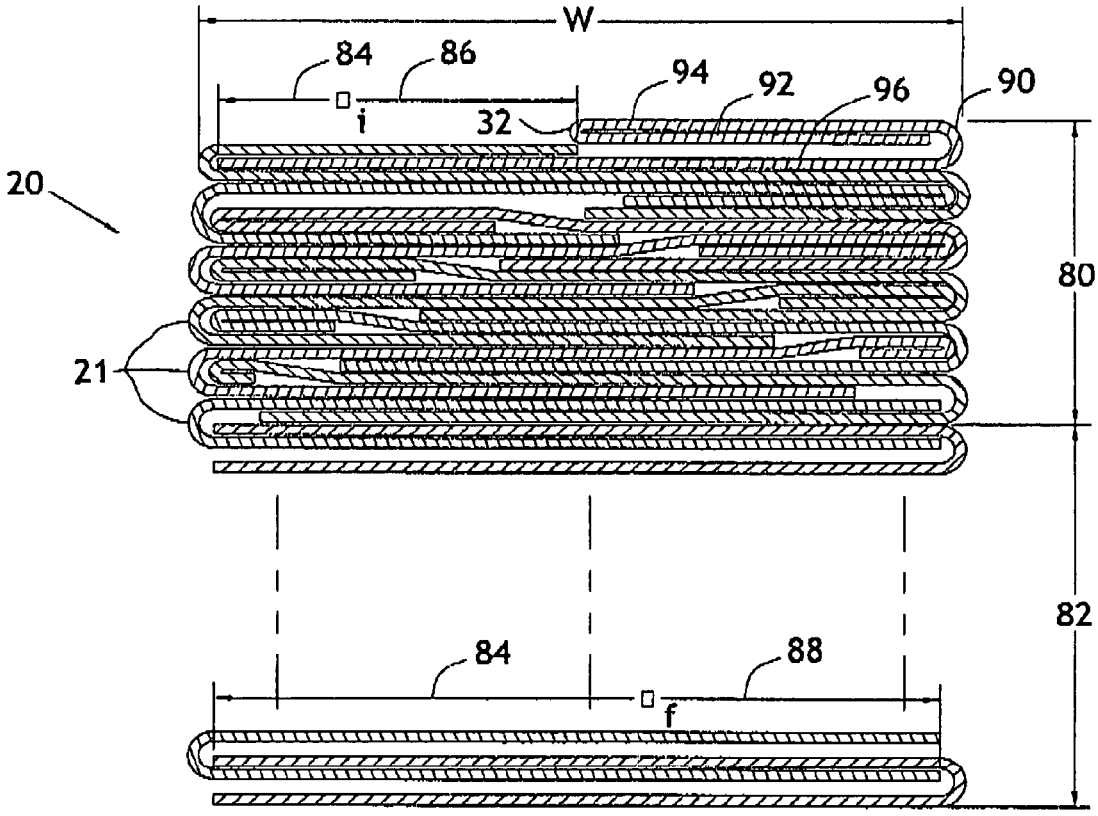
FIG. 2 illustrates an end view of an alternative embodiment of an interfolded stack of sheets of the present invention.
Figure 3:
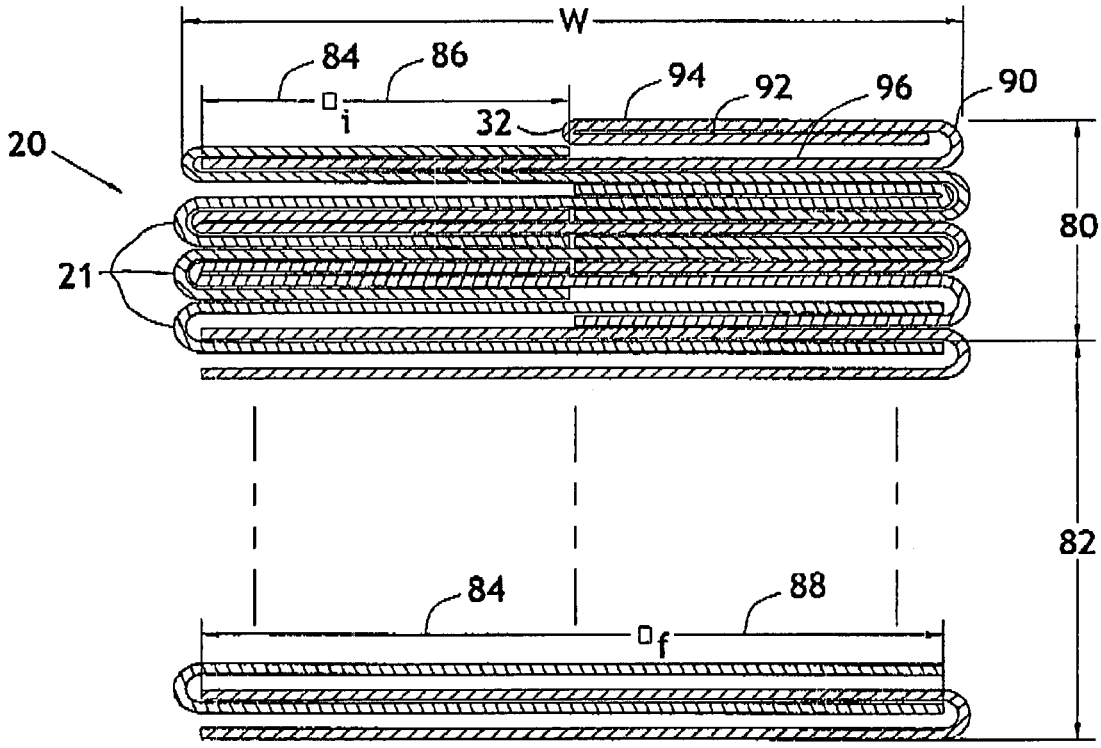
FIG. 3 illustrates an end view of an alternative embodiment of an interfolded stack of sheets of the present invention.

Referring now to FIGS. 1, 2, and 3 an interfolded stack or clip 20 is illustrated. The clip 20 comprises a plurality of individual interleaved sheets 21 folded from a sheet material 22. The sheets 21 within the clip are interfolded for pop-up dispensing. In various embodiments of the invention, the clip can contain between about 10 to about 500 sheets, or between about 50 to about 300 sheets, or between about 60 to about 150 sheets. In one embodiment, the clip is a stack of interfolded two or three ply facial tissue sheets containing between about 60 to about 135 individual facial tissue sheets.

Figure 4:
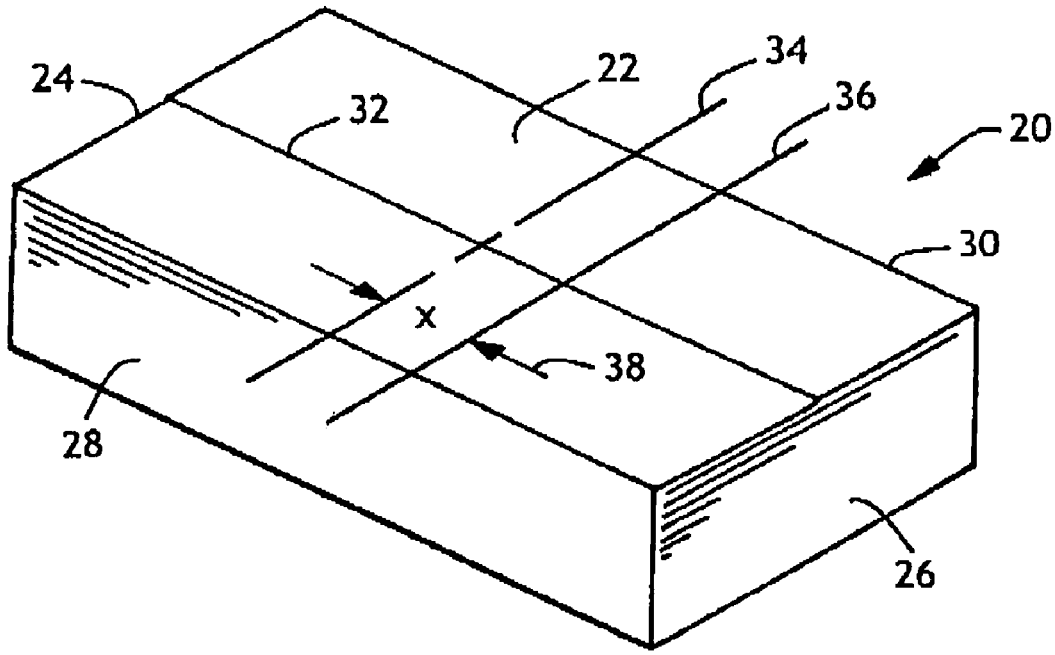
FIG. 4 illustrates the stack of FIG. 1, 2, or 3 in a perspective view.

Referring to FIG. 4, the clip 20 has a first 24 and a second 26 opposing end, and a first 28 and a second 30 opposing side. Typically, a free end 32 of the top sheet is positioned near the center of the clip and aligned with the longitudinal central axis so that it can be easily accessed after the clip is placed into a dispenser. The clip also has a transverse central axis 34 and a transverse fold axis 36. The transverse fold axis 36 can be located at the transverse central axis or it can be located an offset distance X (reference numeral 38) to either side of the transverse central axis 34.

The clip of FIG. 1, as viewed looking at the second clip end 26, is interfolded such that the overall width, W, of each folded sheet is substantially the same. As used herein "substantially the same overall folded width" means that the overall folded width variation of each sheet in the stack is less than about 15%, desirably less than about 10%, and more desirable less than about 5%. Furthermore, any vertical line passing through the stack contains approximately the same number of sheets, plies, or layers. Unlike the stack disclosed in U.S. Pat. No. 6,543,643, this provides a shorter clip for a given number of folded sheets, and also results in a more uniform clip. If the non-uniform clip of U.S. Pat. No. 6,543,643 were folded into a U-shape and then placed in an upright dispenser, poor dispensing can occur since the clip is taller for a fixed number of sheets (takes up more space when folded) and the width variations of the clip could affect proper sheet dispensing. Additionally, non-uniform clips can be harder to handle on automated packaging equipment and conveyors when transported at high rates of speed. For example, the narrow upper layer may be prone to move or skew with respect to the wider lower layer during handling resulting in downtime and jam ups of the machinery. This can be especially true for dry sheet materials as opposed to wet sheet materials, which generally have more interlayer adhesion.

The clip of FIG. 1 is interfolded in a unique way to reduce sheet tears without an increase in fallback. In particular, the stack 20 has an upper layer 80 and a lower layer 82. Only a few V-folded sheets are shown in the lower layer, but the layer could have any number of additional sheets as indicated by the dashed lines. All of the individual sheets in the stack have an overlap distance O (84) defined as the distance a preceding sheet is in interleaved contact with a subsequent sheet. It is not necessary that the overlap distance O for each layer (80, 82) be constant; however, the overlap distance O for the sheets in the upper layer should be less than the overlap distance O for the sheets in the lower layer.

While not wishing to be bound by theory, it is believed that improved dispensing will result since sheet-to-sheet friction will be reduced with a shorter overlap distance. As such, sheet tears for the initial sheets removed from the dispenser can be reduced. In the highly contorted U-shaped clip of an upright dispenser, too much sheet-to-sheet friction can be a large factor contributing to sheet tears since the folded panels of the sheet must flex and bend significantly to be withdrawn out of the dispensing opening. It has been noted that sheet tears are generally a problem for only the first 1-5 sheets dispensed from an upright dispenser with a significant reduction in tears for any subsequent sheets thereafter being dispensed. Since only a few sheets are removed before the incidence of tearing is greatly reduced, it is unlikely that much of the initial clip compression has been relieved at this point because each individual sheet is relatively thin. Dispensing just a few sheets is unlikely to appreciably change the folded width of the clip in the upright dispenser. After the initial sheets have been dispensed, the overlap distance O can be lengthened without causing an increase in sheet tears during dispensing. Increasing the overlap distance O will result in a corresponding increase in the sheet-to-sheet friction. As such, fallback for sheets in the lower layer are reduced. In this manner, the dispensing characteristics of the sheets can be improved by controlling the overlap distance O for each sheet or layer within the stack.

Different fold types can be employed in the upper and lower layers (80, 82) to change the overlap distance O and the concomitant dispensing characteristics. In the embodiment of FIG. 1, the upper layer sheets 80 are interleaved Z-folded sheets (with the exception of the first sheet discussed later) and the lower layer sheets 82 are interleaved V-folded sheets. At the interfold between the $11^{th}$ sheet and the $12^{th}$ sheet, the Z-folded $11^{th}$ sheet of the upper layer is interfolded with the V-folded $12^{th}$ sheet of the lower layer. The overlap distance O can be varied between an initial overlap distance $O_i$ (86) and a final overlap distance $O_f$ (88). In the embodiment of FIG. 1, the overlap distance O progressively increases in approximately equal steps from the initial overlap distance $O_i$ (86) final overlap distance $O_f$ (88) over the span of ten sheets. An abrupt change in the overlap distance O can be problematic for certain sheet materials during dispensing. Without wishing to be bound by theory, it is believed that the gradual progression of the overlap distance O results in fewer dispensing failures; especially, when making the transition from sheets in the upper layer 80 to sheets in the lower layer 82.

Referring now to FIG. 2, an alternative embodiment of the interfolded stack is shown. The overall width, W, of each folded sheet is substantially the same. The stack 20 has an upper layer 80 and a lower layer 82. All of the sheets in the stack have an overlap distance O (84) defined as the interfolded distance a preceding sheet is in interleaved contact with a subsequent sheet. It is not necessary that the overlap distance O for each layer (80, 82) be constant; however, the overlap distance O for the sheets in the upper layer should be less than the overlap distance O for the sheets in the lower layer.

Different fold types can be employed in the upper and lower layers (80, 82) to change the overlap distance O and the concomitant dispensing characteristics. In the embodiment of FIG. 2, except for the first two sheets, the upper layer sheets 80 are interleaved C-folded sheets and the lower layer sheets 82 are interleaved V-folded sheets. The first sheet is J-folded and interfolded with the second sheet that is Z-folded and interfolded with the third sheet that is C-folded. At the interfold between the $11^{th}$ sheet and the 12th sheet, the C-folded $11^{th}$ sheet of the upper layer is interfolded with the V-folded $12^{th}$ sheet of the lower layer. The overlap distance O can be varied between an initial overlap distance $O_i$ (86) and a final overlap distance $O_f$ (88). In the embodiment of FIG. 2, the overlap distance O progressively increases in approximately equal steps from the initial overlap distance $O_i$ (86) to the final overlap distance $O_f$ (88) over the span of ten sheets.

Referring now to FIG. 3, an alternative embodiment of the interfolded stack is shown. The overall width, W, of each folded sheet is substantially the same. The stack 20 has an upper layer 80 and a lower layer 82. All of the sheets in the stack have an overlap distance O (84) defined as the interfolded distance a preceding sheet is in interleaved contact with a subsequent sheet. It is not necessary that the overlap distance O for each layer (80, 82) be constant; however, the overlap distance O for the sheets in the upper layer should be less than the overlap distance O for the sheets in the lower layer.

Different fold types can be employed in the upper and lower layers (80, 82) to change the overlap distance O and the concomitant dispensing characteristics. In the embodiment of FIG. 3, except for the first sheet, the upper layer sheets 80 are interleaved Z-folded sheets and the lower layer sheets 82 are interleaved V-folded sheets. The overlap distance O is substantially constant for the upper layer 80 at the initial overlap distance $O_i$ (86) over the first six sheets. The overlap distance O is also substantially constant for the lower layer 82 at the final overlap distance $O_f$ (88). At the interfold between the $6^{th}$ sheet and the $7^{th}$ sheet, the Z-folded $6^{th}$ sheet of the upper layer is interfolded with the V-folded $7^{th}$ sheet of the lower layer.

In the various embodiments of the stack, the initial overlap distance $O_i$ can be between about 15% to about 45%, or between about 15% to about 40%, or between about 20% to about 35% of the unfolded sheet width. In the embodiments of FIGS. 1, 2, and 3 the initial overlap distance $O_i$ is approximately 25%.

The maximum final overlap distance $O_f$ is related to the unfolded sheet width, the overall clip width, and the type of fold used. A reduced final overlap distance $O_f$ between adjacent sheets can be achieved by increasing the clip width or by using a different fold having less overlap distance—i.e. Z-fold instead of V-fold. In the various embodiments of the stack, the final overlap distance $O_f$ can be between about 35% to about 50%, or between about 40% to about 50%, or between about 45% to about 50% of the unfolded sheet width. In the embodiments of FIGS. 1, 2, and 3 the final overlap distance $O_f$ is approximately 50%.

In various embodiments of the stack, the upper layer can comprise between about 3 to about 50 sheets, or between about 3 to about 40 sheets, or between about 3 to about 20 sheets, or between about 4 to about 15 sheets, or between about 5 to about 10 sheets. In various embodiments of the stack, the overlap distance O can increase from an initial overlap distance, $O_i$, to a final overlap distance, $O_f$, in about 20 sheets or less, in about 15 sheets or less, in about 10 sheets or less, or in about 5 sheets or less. The progression in overlap distance O can occur in fewer sheets than the total number of sheets present in the upper layer. For example, the overlap distance O can be substantially constant for an initial portion of the upper layer and then the overlap distance O can progressively increase for the remaining portion of the upper layer.

In various embodiments of the stack, the upper layer can include Z-folded, C-folded, or J-folded interleaved sheets. In various embodiments of the stack, the lower layer can include V-folded, or Z-folded or C-folded interleaved sheets with an overlap distance O greater than the overlap distance O of the upper layer sheets.

In various embodiments of the invention, the first sheet(s) of the stack 20 can be folded into a different configuration to serve as a starter sheet 90. Desirably, the starter sheet 90 has a folded edge for the free end 32 that is positioned near the middle of the clip. Alternatively, the free end 32 can be a single layer or ply. In the illustrated embodiments of FIGS. 1, 2, and 3, the starter sheet 90 is folded into a J-fold, having a first panel 92 that is folded under a second panel 94 to create the shorter "leg" of the J. The first and second panels (92, 94) are then folded over a third panel 96, forming the longer leg of the J. The third panel 96 is interleaved with the second sheet of the clip, which can be either a Z-folded or C-folded sheet, to define the initial overlap distance $O_i$. Desirably, the first and second panels (92, 94) are approximately the same width and that width is approximately ½ of the overall width, W, of the clip. The third panel 96 has a width that is approximately equal to the overall width, W, of the clip. Alternative starter sheets can be used instead of the J-shaped sheet that is illustrated. Suitably folded starter sheets and apparatus to fold them are disclosed in U.S. Pat. No. 6,238,328, entitled Folding Device that issued May 29, 2001, to Loppnow et al., and in U.S. Pat. No. 6,685,050, entitled Folded Sheet Product, Dispenser, and Related Assembly that issued Feb. 3, 2004, to Schmidt et al. One or more sheets can be folded together to create the starter sheet such that the first two dispensed sheets come out together thereby reducing the tearing incidence at the start of dispensing.

Figure 5:
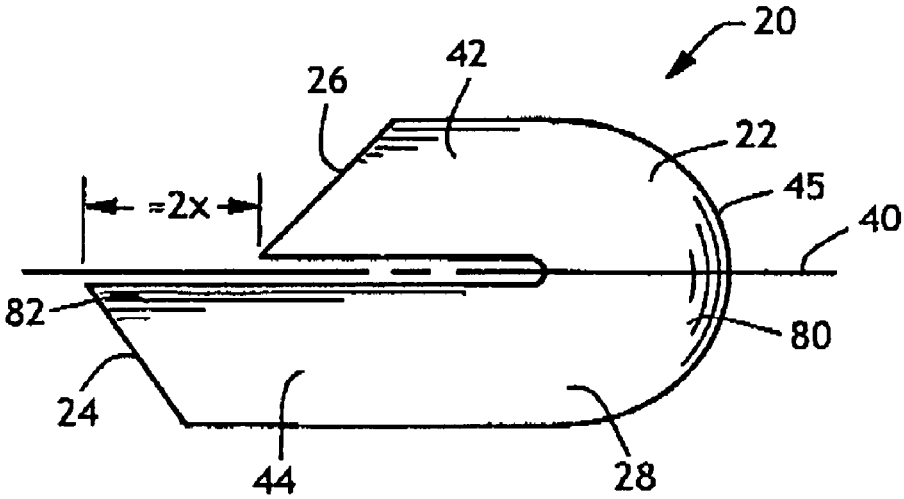
FIG. 5 illustrates the stack of FIG. 4 folded about a transverse fold axis.

Referring now to FIG. 5, the clip or stack 20 of FIGS. 1, 2, 3, and 4 can assume a J-shape as shown in FIG. 5 or a symmetrical U-shape (FIG. 8) when folded about the transverse fold axis 36. Once folded, the folded clip 20 has a longitudinal fold axis 40 where the first clip portion 42, or upper portion of the clip, touches or lies adjacent to the second clip portion 44, or lower portion of the clip. The clip also has a folded end 45 located opposite the first and second ends (24, 26). Once folded, the second end 26 is offset a distance of approximately 2X relative to the first, end 24 when the fold axis 36 is offset by an offset distance x. Additionally, the first and second ends (24, 26) become angled or slanted relative to the longitudinal fold axis 40, since the radius of curvature for each sheet increases as you move outward from the inside to the outside of the folded clip. In various embodiments of the invention, the offset distance X can be between about 0.0 mm to about 70 mm, or between about 2 mm to about 40 mm, or between about 5 mm to about 20 mm, or between about 5 mm to about 15 mm. In one embodiment, the offset distance X is approximately 9 mm when a facial tissue clip having an overall length of approximately 212 mm was folded into a J-shaped clip. Selection of the offset distance X will depend, to some extent, on the size of the dispenser the clip is placed into and/or the length and width of the clip prior to folding the clip into a J-shape.

Figure 6:
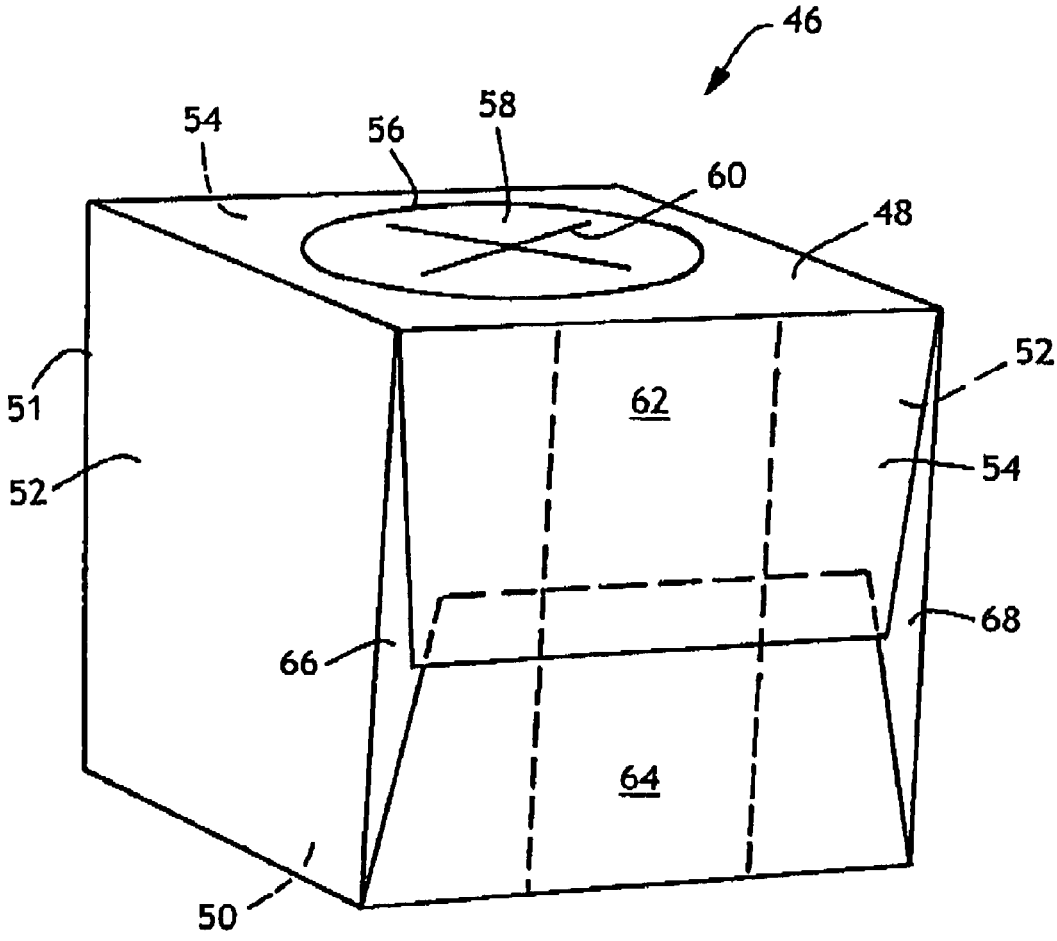
FIG. 6 illustrates an upright dispenser.

Referring now to FIG. 6, a perspective view of one embodiment of an upright dispenser 46 containing the folded clip is illustrated. The dispenser includes a top 48, a bottom 50, and a sidewall 51 formed from two pairs of opposing sidewalls 52 and 54 that intersect at approximately 90 degree angles. The top 48 includes a dispensing opening 56 that can be any size or shape such as square, rectangular, circular, triangular or oval. In an alternative embodiment, the dispensing opening 56 has a portion that resides in the top and another portion that resides in the sidewall 51.

The dispensing opening can include a dispensing window 58 made from a suitable material such as a film, nonwoven, or paper material that can retain a partially dispensed sheet within the dispensing opening for pop-up dispensing. The dispensing window 58 can include a dispensing orifice 60 that can be a slit; a curvilinear line; a geometric shape such as an oval, a circle, or a triangle; or an X-shaped, +-shaped or H-shaped slit or slot. Alternatively, the dispensing window can be eliminated and fingers or tabs projecting into the dispensing opening 56 can be used to retain the partially dispensed sheet.

For ease of loading the clip into the dispenser using automated packaging equipment, generally the first pair of opposing sidewalls 52 are unitary and the second pair of opposing sidewalls 54 are formed from a plurality of flaps. The second pair of opposing sidewalls 54 can include an upper major flap 62, a lower major flap 64, a left minor flap 66, and a right minor flap 68. The flaps can be folded such that they overlap and then are glued together to form the second pair of opposing sidewalls 54 after filling the dispenser 46 with the stack 20.

Figure 7:
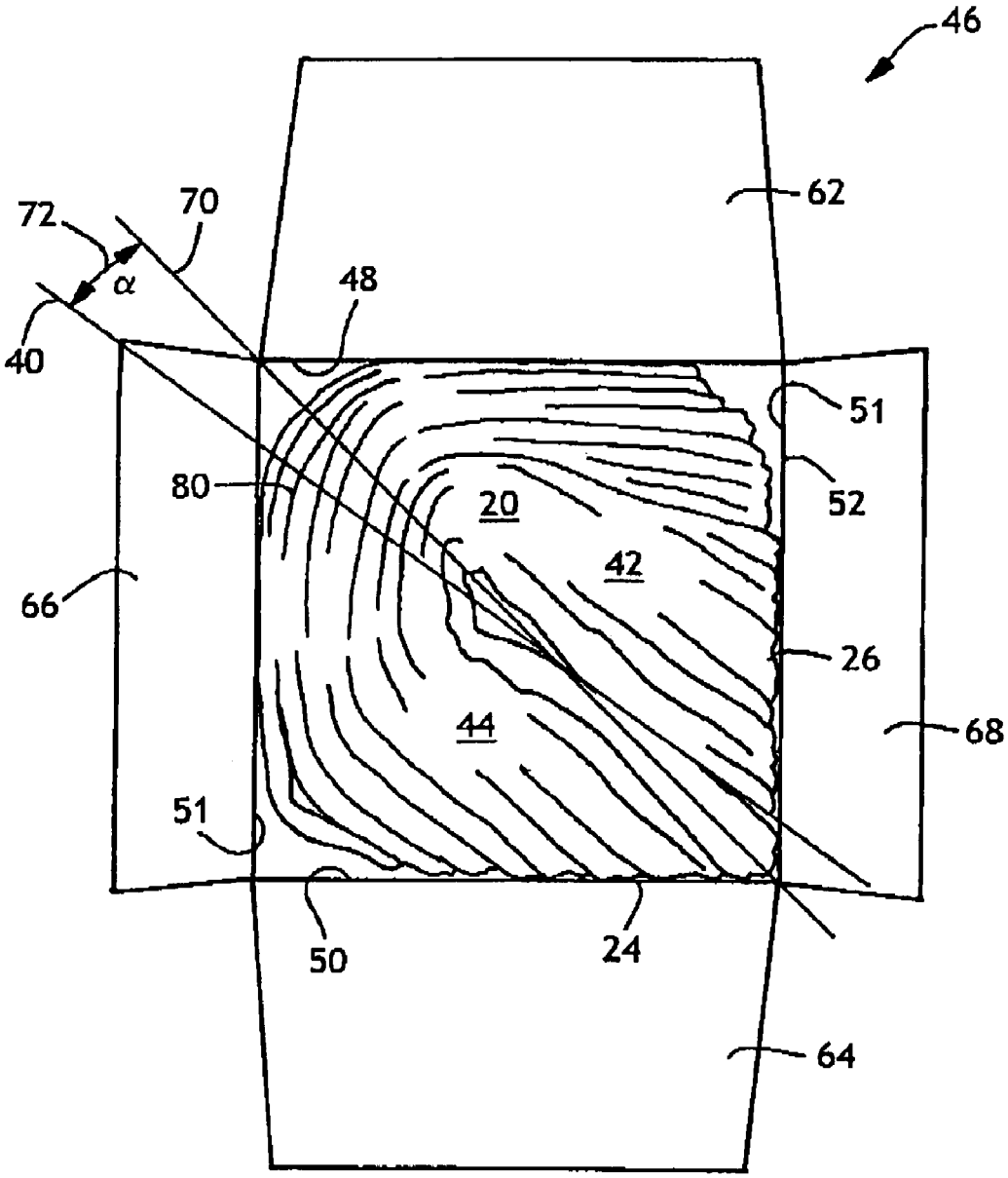
FIG. 7 illustrates the dispenser of FIG. 6 with one side open to show one position of the folded stack within the dispenser.

Referring now to FIG. 7, one embodiment of the folded clip within the dispenser 46 can be observed with the flaps opened on one side of the dispenser. The folded clip is tilted within the dispenser such that the longitudinal fold axis 40 is not perpendicular to the top 48 as seen in the dispenser illustrated in FIG. 8. Tilting of the folded clip can result in an improved utilization of the available space within the dispenser by either allowing for more sheets to be contained by the dispenser with no increase in dispensing problems or by reducing the occurrence of the dispensing problems encountered for the same number of sheets.

Figure 8:
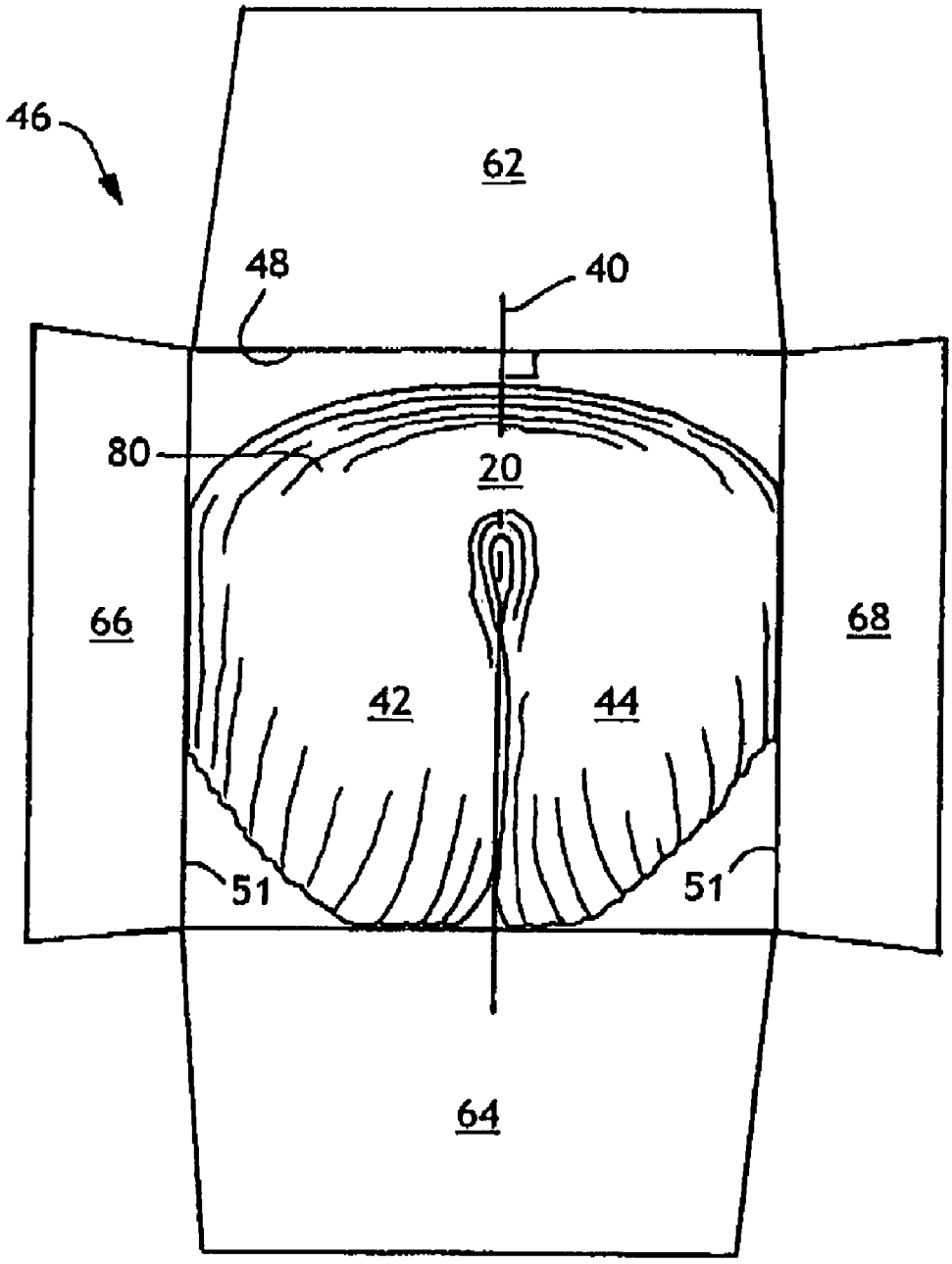
FIG. 8 illustrates the dispenser of FIG. 6 with one side open to show another position of the folded stack within the dispenser.

The inventors have determined that by loading a J-shaped or U-shaped clip into the dispenser as illustrated, the dispenser's individual sheet capacity for the same type of sheet material can be increased by up to about 30 percent without an increase in dispensing problems. It is believed that the increased sheet capacity results from not having the first and second clip portions (42 and 44) on opposite sides of the longitudinal fold axis 40 pushing against the vertical sidewall, as shown in the dispenser of FIG. 8, thereby reducing interlayer sheet-to-sheet friction. As shown in FIG. 7, the first clip portion 42 is free to move up towards the top 48 while the second clip portion lies at an angle relative to the bottom 50. This reduces the pressure between the folded clip 20 and the interior portions of the dispenser. As a result, in one embodiment, the sheet material at the second end 26 is oriented approximately perpendicular to one of the first pair of opposing walls 52, while the upper sheets of the first clip portion 42 are substantially parallel to the top 48. The folded clip 20 takes on a more square overall shape when positioned into the dispenser, thereby utilizing more of the carton's interior space and significantly reducing the force of the clip against the interior of the dispenser.

The above benefits can be achieved by orientating the longitudinal fold axis 40 such that the axis 40 is aligned with or rotated past a diagonal dispenser axis 70 that intersects two opposing corners of the dispenser 46. The diagonal dispenser axis 70 is drawn between two opposing corners where the top 48 joins the sidewall 51 and where the bottom 50 joins the sidewall 51. The diagonal dispenser axis 70 should be drawn between the pair of opposing corners that minimizes an angle $\alpha$ (72) between the longitudinal fold axis 40 and the diagonal dispenser axis 70 as illustrated, as opposed to between the opposite pair of opposing corners. In the illustrated embodiment, the longitudinal fold axis 40 is oriented to intersect with the dispenser's sidewall 51 as opposed to the top 48, as done in the dispenser shown in FIG. 8. If the longitudinal fold axis 40 is aligned with the diagonal dispenser axis 70, it still intersects with the sidewall 51 at the corner where the sidewall 51 meets the top 48. In various embodiments of the invention, the angle $\alpha$ (72) between the diagonal dispenser axis 70 and longitudinal fold axis 40 can be between about 0 to about 45 degrees, or between about 0 degrees to about 30 degrees, or between about 1 degree to about 20 degrees, or between about 1 degree to about 10 degrees.

Referring now to FIG. 8 another position for the stack 20 of FIGS. 1, 2, 3, and 4 within the dispenser 46 is shown. The U-shaped folded clip is positioned such that the longitudinal fold axis 40 intersects with the dispenser's top 48 at any position along the width of the top. In one desired embodiment, the longitudinal fold axis 40 intersects the top 48 at approximately a 90 degree angle. The orientation of FIG. 8 has the advantage that many commercially available packaging machines are available to automatically place the folded clip into the dispenser 46 in the illustrated orientation. Because the folded clip has been interfolded in an inventive manner as discussed in relation to FIG. 1, 2, or 3, reduced dispensing problems can be realized. In particular, sheet tears for the initial sheets dispensed can be reduced without a corresponding increase in tissue fallback or multiple dispensing.

While the invention has been so far discussed in relation to upright facial tissue dispensers, the invention is not limited only to this embodiment. Other sheet materials can be placed into the dispenser or the dispenser can be configured by suitable means to dispense wet sheet materials. Additionally, the invention is not limited to upright or boutique style dispensers. Flat dispensers or dispensers with varying geometric sidewall shapes, such as oval, circular, triangular, or hexagonal can be used with the clips of the present invention. Furthermore, the dispensing opening can be positioned anywhere on the dispenser and is not limited to being positioned solely on the dispenser's top.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

I claim:

1. A product comprising:

an interfolded stack containing a plurality of individual interleaved sheets folded from a sheet material;

each of the sheets having substantially the same overall folded width and having an overlap distance O representing the distance a preceding sheet is in interleaved contact with a subsequent sheet;

the stack having an upper layer and a lower layer; and wherein the overlap distance O is less for the sheets in the upper layer than for the sheets in the lower layer and wherein the overlap distance for the sheets in the upper layer progressively increases from an initial overlap distance $O_i$ to a final overlap distance $O_f$.

2. The product of claim 1 wherein the upper layer comprises Z-folded sheets and the lower layer comprises V-folded sheets.

3. The product of claim 1 wherein the upper layer comprises C-folded sheets and the lower layer comprises V-folded sheets.

4. The product of claim 1 wherein the sheets in the upper layer have an initial overlap distance $O_i$ and $O_i$ between about 15% to about 45% of the unfolded sheet width.

5. The product of claims 1, 2, or 3 wherein the sheets in the upper layer have an initial overlap distance $O_i$ and $O_i$ is between about 20% to about 35% of the unfolded sheet width.

6. The product of claim 1 wherein the sheets in the lower layer have a final overlap distance $O_f$ and $O_f$ is between about 35% to about 50% of the unfolded sheet width.

7. The product of claim 5 wherein the sheets in the lower layer have a final overlap distance $O_f$ and $O_f$ is between about 45% to about 50% of the unfolded sheet width.

8. The product of claim 1, 2, or 3 wherein the increase in overlap distance occurs in about 20 sheets or less.

9. The product of claims 1, 2, or 3 further comprising the stack folded about an offset transverse fold axis into a J-shaped folded clip; the folded clip including a folded end and a longitudinal fold axis; the folded clip placed into an upright dispenser having a top, a bottom, a sidewall, and a dispensing opening in the top with the upper layer positioned in the vicinity of the dispensing opening; and wherein the longitudinal fold axis of the folded clip intersects the dispenser's sidewall.

10. The product of claims 1, 2, or 3 further comprising the stack folded about a transverse fold axis into a U-shaped folded clip; the folded clip including a folded end and a longitudinal fold axis; the folded clip placed into an upright dispenser having a top, a bottom, a sidewall, and a dispensing opening in the top with the upper layer positioned in the vicinity of the dispensing opening; and wherein the longitudinal fold axis of the folded clip intersects the dispenser's top.

11. The product of claim 1 wherein the sheet material comprises wet sheet material.

12. The product of claim 1 wherein the sheet material comprises tissue paper.

13. The product of claim 1 wherein the first sheet in the upper layer comprises a staler sheet having a folded free end.

14. The product of claim 11 wherein the starter sheet comprises a J-shape having a first panel folded under a second panel and also having the first and second panels folded over a third panel.

* * * * *